US005176719A

United States Patent [19]

Harandi et al.

[11] Patent Number: 5,176,719

[45] Date of Patent: Jan. 5, 1993

[54] UPGRADING C4 MIXED HYDROCARBONS BY TRANSHYDROGENATION AND ISOBUTENE ETHERIFICATION

[75] Inventors: Mohsen N. Harandi, Lawrenceville; Hartley Owen, Belle Mead, both of N.J.

[73] Assignee: Mobil Oil Corporation, Fairfax, Va.

[21] Appl. No.: 614,479

[22] Filed: Nov. 16, 1990

Related U.S. Application Data

[63] Continuation-in-part of Ser. No. 454,473, Dec. 21, 1989, Pat. No. 4,975,097, which is a continuation-in-part of Ser. No. 179,729, Apr. 11, 1988, abandoned, which is a continuation-in-part of Ser. No. 480,710, Feb. 15, 1990, Pat. No. 4,826,507.

[51] Int. Cl.[5] ..... C10L 1/18

[52] U.S. Cl. ..... 44/449; 568/697

[58] Field of Search ..... 44/449; 568/697

[56] References Cited

U.S. PATENT DOCUMENTS

| | | | |
|---|---|---|---|
| 4,329,516 | 5/1982 | Al-Muddarris | 568/697 |
| 4,361,422 | 11/1982 | Derrien et al. | 44/449 |
| 4,377,393 | 3/1983 | Schleppinghoff | 44/449 |
| 4,546,204 | 10/1985 | Parris | 568/697 |
| 4,695,662 | 9/1987 | Vora | 585/324 |
| 4,826,507 | 5/1989 | Harandi et al. | 44/449 |
| 4,925,455 | 5/1990 | Harandi et al. | 585/415 |
| 4,975,097 | 12/1990 | Harandi et al. | 44/449 |
| 4,981,491 | 1/1991 | Harandi et al. | 44/449 |
| 5,013,329 | 5/1991 | Bell et al. | 44/448 |

*Primary Examiner*—Ellen McAvoy

*Attorney, Agent, or Firm*—Alexander J. McKillop; Charles J. Speciale; L. G. Wise

[57] ABSTRACT

A technique for converting olefinic light hydrocarbons rich in butenes and butanes to ether-rich liquid fuels including etherification and transhydrogenation operations. The preferred process includes: reacting a mixed C4 hydrocarbon stream containing isobutene and n-butenes with lower aliphatic alcohol in an etherification zone in contact with an acidic etherification catalyst under etherification conditions whereby an effluent stream containing C5+ tertiary-alkyl ether is produced; separating the etherification effluent stream to provide a liquid stream comprising C5+ ether and an olefinic stream comprising unreacted C4 hydrocarbons; contacting at least the n-butenes from the $C_4$ olefinic hydrocarbon stream with isobutane under transhydrogenation conditions in the presence of transhydrogenation catalyst whereby isobutane is converted to isobutene; separating transhydrogenation effluent to recover a C4 olefinic intermediate stream containing isobutene; and passing at least a portion of the isobutene-containing intermediate stream to the etherification zone for conversion to tertiary-alkyl ether.

8 Claims, 1 Drawing Sheet

FIG.
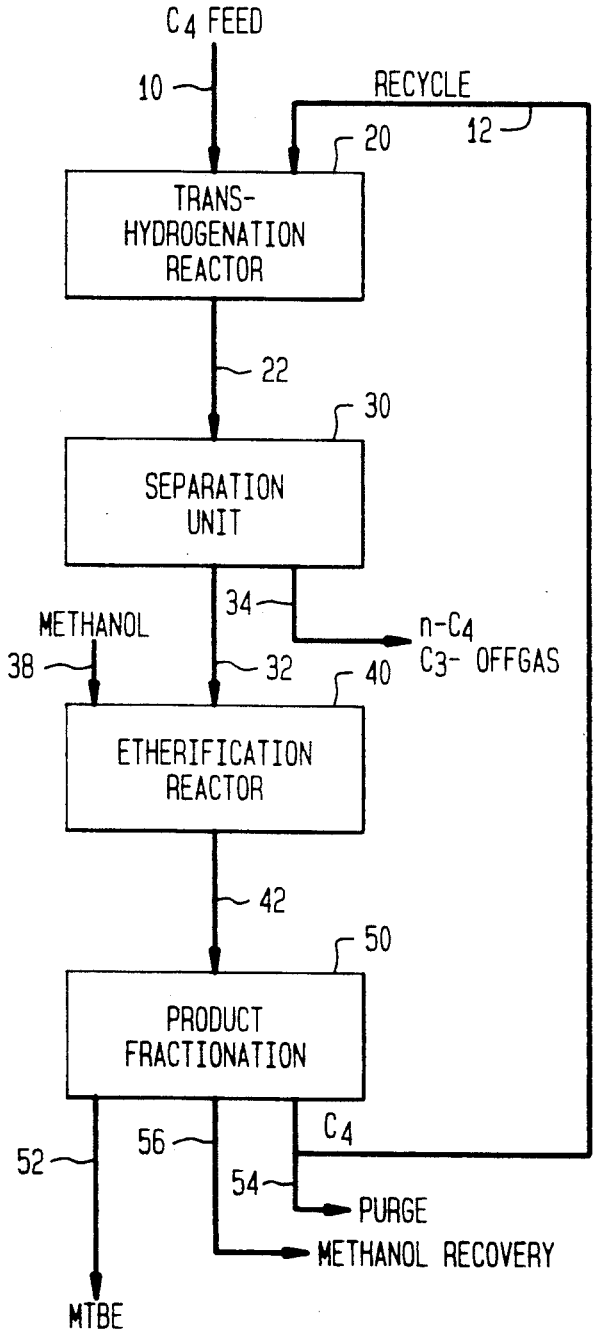

UPGRADING C4 MIXED HYDROCARBONS BY TRANSHYDROGENATION AND ISOBUTENE ETHERIFICATION

REFERENCE TO COPENDING APPLICATION

This application is a continuation-in-part of U.S. patent application Ser. No. 07/454,473, filed Dec. 21, 1989, now U.S. Pat. No. 4,975,097, which is a continuation-in-part of U.S. patent application Ser. No. 07/179,729, filed Apr. 11, 1988 (abandoned), which is a continuation-in-part of Ser. No. 480,710 filed Feb. 15, 1990, now U.S. Pat. No. 4,826,507, incorporated by reference.

BACKGROUND OF THE INVENTION

This invention relates to processes for converting lower aliphatic alcohol, such as methanol, and C4 olefinic hydrocarbons to high octane liquid fuel. In particular, this invention relates to a system for the production of tertiary-butyl ethers in the presence of a lower alkanol, such as methanol, combined with the conversion of olefins to gasoline and a transhydrogenation step to convert branched paraffins to branched olefins for recycle.

There has been considerable development of processes for synthesis of alkyl tertiary-alkyl ethers as octane boosters in place of conventional lead additives in gasoline. The etherification processes for the production of methyl tertiary alkyl ethers, in particular methyl t-butyl ether (MTBE) and t-amyl methyl ether (TAME) have been the focus of recent research. It is known that isobutylene and other isoalkenes produced by hydrocarbon cracking may be reacted with methanol, ethanol, isopropanol and other lower aliphatic primary and secondary alcohols over an acidic catalyst to provide tertiary ethers. Methanol is considered the most important $C_1$-$C_4$ oxygenate feedstock because of its widespread availability and low cost. Therefore, primary emphasis herein is placed on MTBE.

It is an object of the present invention to provide an improved process for the production of C5+alkyl t-butyl ether from isoalkene-rich hydrocarbons, especially MTBE manufacture. It is another object of the present invention to provide an integrated process and reactor system for production of liquid fuel components from C4 aliphatic hydrocarbons incorporating etherification with alkanol and transfer dehydrogenation of paraffins, especially isobutane.

SUMMARY OF THE INVENTION

It has been discovered that high octane gasoline can be produced employing an improved C4 transhydrogenation and etherification process utilizing lower alcohols such as methanol. In a preferred embodiment, a continuous process is provided for a) reacting a mixed C4 hydrocarbon stream containing isobutene and n-butenes with lower aliphatic alcohol in an etherification zone in contact with an acidic etherification catalyst under etherification conditions whereby an effluent stream containing C5+tertiary-alkyl ether is produced;

b) separating the etherification effluent stream to provide a liquid stream comprising C5+ether and an olefinic stream comprising unreacted C4 hydrocarbons;

c) contacting at least the n-butenes from the $C_4$ olefinic hydrocarbon stream with isobutane under transhydrogenation conditions in the presence of transhydrogenation catalyst whereby isobutane is converted to isobutene;

c) separating transhydrogenation effluent to recover a C4 olefinic intermediate stream containing isobutene; and d) passing at least a portion of the isobutene-containing intermediate stream to the etherification zone for conversion to tertiary-alkyl ether.

DESCRIPTION OF THE DRAWING

The figure is a schematic process flow sheet of the present invention.

DETAILED DESCRIPTION OF THE INVENTION

In the following description, parts by weight and metric units are employed unless otherwise indicated.

Olefinic feedstock materials may be derived from several sources, particularly C5- FCC cracked gas rich in mixed butenes and butanes. Other suitable feedstocks may be obtained from conversion of oxygenates, such as methanol to olefins ("MTO"). Considerable variation is permissible in the ratios of isobutene, 1-butene, 2-butene, n-butane and isobutane. Feedstocks containing a relatively large amount (ie- at least 10%) of etherifiable isobutene (isobutylene) can be sent directly to the etherification reactor prior to transhydrogenation of unreacted C4 aliphatics recovered from etherification effluent. For feedstocks containing relatively low isobutene:isobutane ratios, it is advantageous to first transfer hydrogen from isobutane-rich components feedstock to convert n-butenes to butanes, as discussed in the following example. Typical feedstocks may contain about 10-50 weight percent (wt. %) n-butenes, 0-40 wt. % isobutene, 10-50% isobutane, and 0-30% n-butane. C3 and C5 hydrocarbons may be present; however, it is preferred to have feedstocks consisting essentially of mixed C4 aliphatics.

Referring now to the drawing, a schematic diagram of a preferred embodiment of the present invention is presented. Hydrocarbon feedstream 10 , a fresh C4 feedstock containing a mixture of n-butane, isobutane and butenes, is introduced into the transhydrogenation reactor 20 for co-conversion with olefinic stream 12 comprising C4 hydrocarbons separated from the etherification step.

Effluent stream 22 from reactor unit 20 is separated in unit 30 to recover an isobutene-rich stream 32 and to recover undesired n-butanes and other C3 light offgas components from the system. In a preferred operating mode, transhydrogenation effluent is separated to recover a C4 olefinic stream rich in isobutene for recycling at least a portion of the isobutene-rich for etherification, and further separation the C4 stream can be effecte with a de-isobutanzer fractionation unit for removing n-butane from the process.

The isobutene stream 32 is passed to etherification reactor 40 and mixed with methanol feed 34. The etherification reaction is conducted preferably at about 60° C. The etherification effluent is passed via line 42 to a fractionator tower 50, wherein a bottom product stream 52 is separated comprising MTBE and byproduct oligomer. The overhead stream from the product fractionator comprises etherification methanol and unreacted light hydrocarbon. The mixture can be passed to an optional methanol separation unit for recovery of unreacted C4 aliphatic hydrocarbons for recycle via line 12 or system purge via 54. Methanol and other oxygenates may be recovered via line 56. However, it is understood that the C4 and methanol components need not be completely separated prior to recycle of the C4 stream for transhydrogenation. The alcohol can be sent to the transhydrogenation zone, where it man be partially converted to hydrocarbons, with unconverted alcohol being recycled to the etherificaton reactor unit.

The $C_4$ paraffins and olefins, rich in n-butenes and isobutane, are passed via line 12 to transhydrogenation zone 20 for reaction with feedstream 10. Optional isobutane or n-butane containing streams may be introduced to the transhydrogenation unit as a supplemental feedstream. At least a portion of the transhydrogenation reaction reactor effluent can be fed to the etherification unit without separating or efficiently separating C3- or other non-reactive components from $C_4$- components. This will allow utilizing unit 50 separation section as the only gas plant in the process.

Optionally, C4- etherification effluent containing unreacted methanol and hydrocarbons may be upgraded in a zeolite catalysis unit, as described in U.S. patent application Ser. No. 07/454,473 filed Dec. 21, 1989, prior to transhydrogenation. It is particularly advantageous to upgrade the purged C4 stream 54 by acid zeolite catalysis.

ETHERIFICATION OPERATION

The reaction of methanol with isobutylene and isoamylenes at moderate conditions with a resin catalyst is known technology, as provided by R. W. Reynolds, et al., *The Oil and Gas Journal*, Jun. 16, 1975, and S. Pecci and T. Floris, *Hydrocarbon Processing*, December 1977. An article entitled "MTBE and TAME - A Good Octane Boosting Combo", by J. D. Chase, et al., *The Oil and Gas Journal*, Apr. 9, 1979, pages 149-152, discusses the technology. A preferred catalyst is a sulfonic acid ion exchange resin which etherifies the reactants, such as Amberlyst 15 resin. Other acid catalysts such as Zeolite Beta or large pore zeolites may be employed.

Processes for producing and recovering MTBE and other methyl tert-alkyl ethers for $C_4$-$C_7$ iso-olefins are known to those skilled in the art, such as disclosed in U.S. Pat. Nos. 4,788,365 and 4,820,877 (Harandi et al). Various suitable extraction and distillation techniques are known for recovering ether and hydrocarbon streams from etherification effluent.

TRANSHYDROGENATION PROCESS OPERATION

An important unit operation in the conversion of iso-paraffins to their corresponding iso-olefins is a form of catalytic dehydrogenation known as transhydrogenation. This can be achieved by high temperature reaction using hydrogenation-dehydrogenation catalyst; however, it is within the inventive concept to employ other types of processes for transhydrogenation in this process step to effect removal of hydrogen from the $C_3$-$C_5$ intermediate alkanes. Typical processes are operated at elevated temperature (about 400°-650° C.) and moderate pressure using a metal oxide such as Cr oxide on a matrix such as alumina or silica. Other dehydrogenation techniques are disclosed in U.S. Pat. No. 4,546,204 (Parris). Recent developments have provided effective noble metal zeolite co-catalysts, as disclosed in U.S. Pat. No. 4,859,567; 4,922,050 and 4,931,416 (Dessau et al), for instance. A suitable catalyst comprises Pt and Sn on ZSM-5 zeolite.

EXAMPLE

A typical C4 refinery stream is converted to ether by the present invention under continuous processing conditions. Based on 100 moles of MTBE product, the hydrocarbon feedstock consists essentially of 129.6 moles of isobutane, 14.5 moles n-butane, 2.4 moles isobutene, 97.5 moles 1-butene and 7.8 moles of C3- light gas. This C4 stream is contacted with transhydrogenation catalyst together with recycled C4's to effect transhydrogenation. The primary stage effluent is fractionated to recover the major amount of undesired n-butane along with other offgases containing about 98.0 moles of n-butane, 15.8 moles i-butane, 29.3 moles C3- light gas, 5.2 moles n-butene and 4.9 moles 1-butene. Following separation of the primary stage effluent, the isobutene-rich stream is mixed with 105.2 moles of methanol (including 5.2 moles of methanol recycle) and contacted with etherification catalyst (Amberlyst 15 polysulfonic acid resin) catalyst under etherification conditions, and 100 moles of MTBE product is recovered from etherification effluent by distillation. Unreacted C4 butenes and isobutane are recovered from the etherification reactor effluent and recycled for transhydrogenation.

Various modifications can be made to the system, especially in the choice of equipment and non-critical processing steps. While the invention has been described by specific examples, there is no intent to limit the inventive concept as set forth in the following claims.

We claim:

1. A process for converting olefinic light hydrocarbons rich butenes and butanes to ether, comprising the steps of:

reacting a mixed C4 hydrocarbon stream containing isobutene and n-butenes with lower aliphatic alcohol in an etherification zone in contact with an acidic etherification catalyst under etherification conditions whereby an effluent stream containing C5+tertiary-alkyl ether is produced;

separating the etherification effluent stream to provide a liquid stream comprising C5+ether and an olefinic stream comprising unreacted C4 hydrocarbons;

contacting at least the n-butenes from the $C_4$ olefinic hydrocarbon stream with fresh $C_4$ feedstock containing isobutane under transhydrogenation conditions in the presence of transhydrogenation catalyst whereby isobutane is converted to isobutene;

separating transhydrogenation effluent to recover a C4 olefinic intermediate stream containing isobutene; and passing at least a portion of the isobutene-containing intermediate stream to the etherification zone for conversion to tertiary-alkyl ether.

2. In the process for converting olefinic light hydrocarbons rich in butenes and butanes to ether, wherein a mixed C4 hydrocarbon stream containing isobutene and n-butenes is reacted with lower aliphatic alcohol to produce C5+tertiary-alkyl ether; the improvement which comprises:

separating etherification effluent to provide a liquid stream comprising C5+ether and an olefinic stream comprising unreacted C4 hydrocarbons including n-butene;

contacting the n-butene from the $C_4$ olefinic hydrocarbon stream with added isobutane under transhydrogenation conditions in the presence of transhydrogenation catalyst whereby isobutane is converted to isobutene;

separating transhydrogenation effluent to recover a C4 olefinic stream rich in isobutene; and recycling at least a portion of the isobutene-rich for et further etherification.

3. The process of claim 2 wherein fresh C4 feedstock containing a mixture of n-butane, isobutane and butenes is introduced into the transhydrogenation step for coconversion the olefinic stream comprising unreacted C4 hydrocarbons separated from the etherification step.

4. The process of claim 2 wherein the alcohol comprises methanol and the fresh C4 feedstock contains about 10–50 weight percent n-butenes, 0–40 wt. % isobutene, 10–50 wt. % isobutane, and 0–30 wt. % n-butane.

5. A process for converting olefinic light hydrocarbons rich in butenes and butanes to methyl t-butyl ether (MTBE), comprising the steps of:

reacting a mixed C4 hydrocarbon stream containing isobutene and n-butenes with methanol in an etherification zone in contact with an acidic etherification catalyst under etherification conditions whereby an effluent stream containing MTBE is produced;

separating the etherification effluent stream to provide a liquid stream comprising MTBE and an olefinic stream comprising unreacted C4 hydrocarbons; and contacting at least the n-butenes from the $C_4$ olefinic hydrocarbon stream with isobutane under transhydrogenation conditions in the presence of transhydrogenation catalyst whereby isobutane is converted to isobutene.

6. The process of claim 5 wherein the C4 hydrocarbons separated from etherification effluent contain residual methanol, which is passed to transhydrogenation.

7. The process of claim 5 wherein the transhydrogenation catalyst comprises Pt and Sn on ZSM-5 zeolite.

8. The process of claim 5 wherein transhydrogenation effluent is separated to recover a C4 olefinic stream rich in isobutene and recycling at least a portion of the isobutene-rich for etherification; and further separating the C4 stream with de-isobutanzer fractionation for removing n-butane from the process.

* * * * *